United States Patent [19]

Mori et al.

[11] 4,011,739

[45] Mar. 15, 1977

[54] FEEDING APPARATUS FOR SHEET-LIKE MATERIALS

[75] Inventors: Yoshinosuke Mori; Migaku Suzuki, both of Ootake; Atsushi Kawai, Hiroshima; Seigi Suzuki, Ootake, all of Japan

[73] Assignee: Mitsubishi Rayon Co., Ltd., Tokyo, Japan

[22] Filed: Sept. 24, 1975

[21] Appl. No.: 616,366

[30] Foreign Application Priority Data

Oct. 23, 1974 Japan ..... 49-122278

[52] U.S. Cl. ..... 68/181 R; 68/158; 118/405; 118/419

[51] Int. Cl.[2] ..... D04B 9/46

[58] Field of Search ..... 118/404, 405, 419, 429; 226/7, 97; 68/158, 181 R

[56] References Cited

UNITED STATES PATENTS

| | | | |
|---|---|---|---|
| 2,131,409 | 9/1938 | Nai | 68/181 R |

FOREIGN PATENTS OR APPLICATIONS

| | | | |
|---|---|---|---|
| 19,188 | 9/1972 | Japan | 68/181 R |
| 467,257 | 9/1935 | United Kingdom | 68/181 R |
| 642,359 | 8/1950 | United Kingdom | 68/181 R |

*Primary Examiner*—Dorsey Newton
*Attorney, Agent, or Firm*—Oblon, Fisher, Spivak, McClelland & Maier

[57] ABSTRACT

A feeding apparatus for a sheet-like material is disclosed wherein means for introducing a rectified liquid stream are oppositely provided on both sides of the inlet portion of a slit type guide passage for the sheet-like material.

10 Claims, 6 Drawing Figures

FEEDING APPARATUS FOR SHEET-LIKE MATERIALS

BACKGROUND OF THE INVENTION

1. Field of the Invention

The present invention relates generally to an improved feeding apparatus for a sheet-like material, and more particularly to such a feeding apparatus which can be most advantageously used for the production of paper or non-woven fabric of regenerated cellulose fibers, such as proposed in U.S. Pat. No. 3,832,281. Especially, the feeding apparatus of the present invention can be advantageously used for the feeding to a shrinking step or subsequent treating steps, such as regenerating, washing, bleaching, and the like, of a web obtained by cutting fibers containing hydroxymethyl cellulose xanthate, forming the thus cut fibers into a web by a wet method and subjecting the wet web so obtained to heating and compressing treatments.

2. Description of the Prior Art

Conventionally, the swing method has been widely employed for overfeeding a wide sheet-like material into a liquid or onto a conveyor. However, according to this method, there is the problem that the position or shape of the sheet-like material being so fed becomes markedly unstable. Besides the swing method, a method by which a sheet-like material is fed together with a liquid stream has also been employed. According to this method, it is possible to surely feed a sheet to a certain position in accordance with the increase in flow rate of the liquid in the case of the passage of the sheet and the liquid being wide, but there are still problems involving the shape of the sheet becoming extremely unstable and even rope-like in extreme cases.

SUMMARY OF THE INVENTION

Accordingly, it is an object of the present invention to provide an improved feeding apparatus which has no such defects as the conventional apparatus and which can surely feed a wide sheet-like material as it is in a well-balanced state to a determined position.

The gist of the present invention by which the foregoing objects and others as well are attained resides in a feeding apparatus for a sheet-like material which is characterized by (*a*) a slit type guide passage for a sheet-like material having a slit which is constant in width, which is gradually decreased from the inlet portion to the outlet portion, and which is curvedly extended in an inclined and downward direction and (*b*) means for introducing a rectified liquid stream which is provided at the inlet portion of the guide passage and which introduces the rectified liquid stream into the guide passage from the whole width of both sides of the inlet portion.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference numerals designate like or corresponding parts and wherein.

DETAILED DESCRIPTION OF THE PREFERRED EMBODIMENTS

Figure 1:
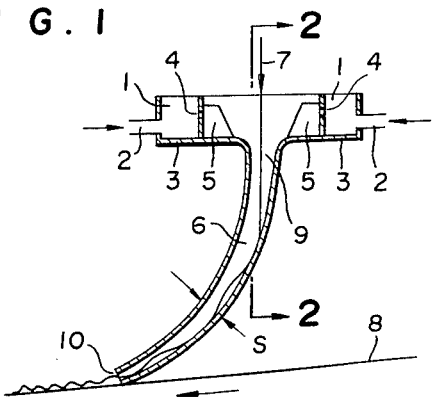
FIG. 1 is a vertical cross-sectional view which shows one embodiment of the present invention.
Figure 2:
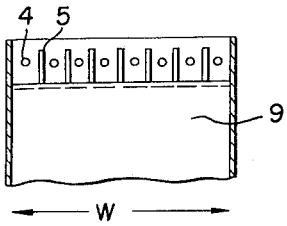
FIG. 2 is a partial cross-sectional view of the apparatus shown in FIG. 1, taken along the line 2—2 thereof.
Figure 3:
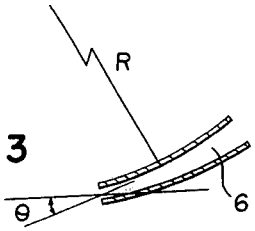
FIG. 3 is an enlarged cross-section of the outlet portion of the slit type guide passage shown in FIGS. 1 and 2.

Referring to the accompanying drawings, and more particularly to FIGS. 1–3 thereof, liquid which is fed into a pair of oppositely disposed liquid supplying tanks 1 through inlet conduit pipes 2 thereof flows out from the tanks 1 through a plurality of liquid supplying holes 4 formed in the opposing inner walls thereof, then flows over bottom plate 3 while being rectified by a plurality of parallel rectifying plates 5 on the other side of such inner walls before being introduced into a guide passage 6 extending downward from the central part of the tank interiors from along the entire width of both sides of an inlet portion 9 of the guide passage 6. The liquid then flows down in the guide passage 6, together with a sheet-like material 7 being fed vertically downwardly into the same inlet portion 9 of the guide passage 6, such that the liquid contacts both opposing surfaces of the sheet-like material 7, and they are delivered then from an outlet portion 10 of the guide passage 6 onto a net conveyor 8.

Among the important points to which attention should be given in such apparatus are the fact that, since the liquid supplying tank is provided for reservoiring liquid being fed from outside and for supplying a uniform stream of liquid to the whole width of the sheet-like material, it is necessary that a given amount of such liquid is stationarily flown out from the entire width of the liquid supplying tank and that the liquid supplying tank has a capacity which is as large as possible in order to reduce the influence of disturbance and to make it easy to rectify the stream of the liquid. Furthermore, it is necessary that the liquid rectifying portion does not produce a flow of the liquid in the direction of the width of the sheet-like material immediately before the liquid contacts the sheet-like material. If a liquid stream having a flow in the direction of the width of the sheet-like material is allowed to contact the sheet-like material, this sheet-like material is caused to partially move in such direction of its width, thereby to result in creases and bends in the sheet-like material within the guide passage. It is further necessary that the slit type guide passage for the sheet-like material has a constant width ($w$) which is wider than the width of the sheet-like material and that the slit, or slits, gradually decrease in size from the inlet portion to the outlet portion in order to stably guide and discharge the sheet like material. If the slit, or slits, of the inlet portion are identical with that of the outlet portion, flow rate at the outlet portion becomes too much higher than that at the inlet portion due to the influence of gravity, whereby air is introduced between the inner surface of the guide passage at the outlet portion and the sheet-like material to thus disturb the sheet-like material. In this case, the following physical characteristics are desired for the apparatus. First, $S_1/S_2$, the ratio of the slit $S_1$ at the inlet portion to slit $S_2$ at the outlet portion is 5 – 10; and preferably that $S_2$ is on the order of 3 – 10mm, while the radius of curvature R of the guide passage is on the order of 100 – 600mm. Then, $V_1/V_2$, the ratio of flow speed $V_1$ of the liquid at the outlet portion to flow speed $V_2$ of the sheet-like material at the outlet portion should be between 3 and 30. The angle $\theta$, formed by the horizontal level and the outlet portion should be 0 – 30°, and preferably 5° – 15°, and the distance between the outlet portion and the conveyor should be 5 – 40mm.

The means for introducing a rectified liquid stream into the guide passage 6 from along the entire width of both sides of the inlet portion 9 of the guide passage 6 in the present invention is not limited to the combination of the liquid supplying tank 1 and the rectifying plates as shown in FIGS. 1 and 2, but rather any means which accomplishes the same purpose as above may obviously be employed.

Figure 4:
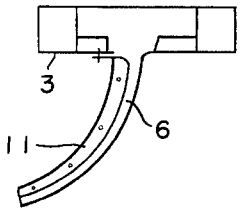
FIGS. 4 and 5 are vertical cross-sectional views which show various modifications of the guide passage.
Figure 5:
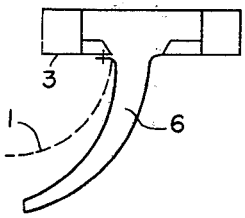

As the guide passage, the following are very convenient in actual industrial operation, namely, one in which a top plate 11 is adjustably fitted to the side plate by bolts and the like so that the slit of the guide passage can be adjusted, depending on the thickness of the sheet-like material, as shown in FIG. 4, or one in which, as shown in FIG. 5, the upper part of the top plate 11 is fitted to the bottom plate 3 by a hinge so that the top plate 11 is raised to the position indicated by the broken line to make it easy to introduce the sheet-like material and is restored to its original position after the sheet-like material has been nearly uniformly spread by the liquid stream.

Figure 6:
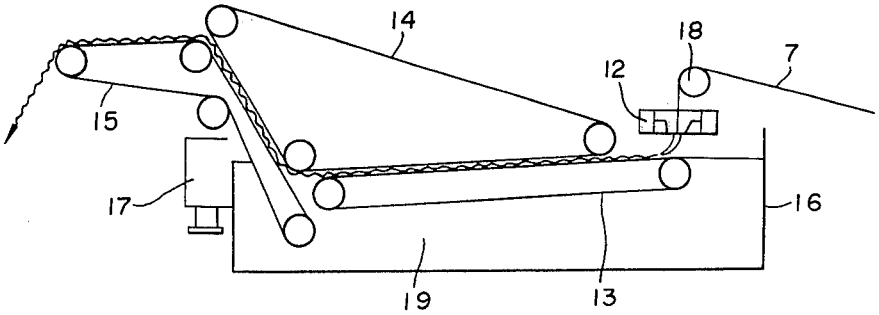
FIG. 6 is a vertical cross-sectional view which shows an example in which the apparatus of the present invention is applied to an apparatus for continuous liquid treatment of sheet-like materials.

Turning now to FIG. 6, the feeding apparatus is shown being applied to an apparatus for continuously treating a sheet-like material with a liquid. In this illustration, the sheet 7 is introduced into the feeding apparatus 12 of the present invention from a delivery roll 18 and is over-fed from the feeding apparatus 12 onto a first net conveyor 13, which travels at a speed slower than the speed of the delivery roll 18, to be successively and uniformly folded thereon. Then, the thus folded sheet 7 is gradually introduced into a treating liquid 19 as it moves along the downwardly inclined conveyor and is successively treated therein while keeping its folded condition between the first conveyor 13 and a second conveyor 14 disposed thereabove. Thereafter, the sheet leaves the first conveyor 13 and is gradually taken out from the treating liquid tank 16, in which the treating liquid 19 is contained and in which the first conveyor 13 is essentially disposed, while being interposed between a third conveyor 15 and the second conveyor 14.

As explained above, the apparatus of the present invention has the peculiar structure in which the specific slit type guide passage for a sheet-like material and the means for introduction of a rectified liquid stream are combined. Therefore, a wide sheet-like material can be securely fed to a certain position in its wide and symmetrical state without causing vertical creases or bends. Especially when the apparatus of the present invention is used in overfeeding a sheet-like material to net conveyors and the like, since the sheet-like material is successively and uniformly folded onto the conveyor as shown in FIG. 6, the present invention can provide remarkable industrial effects, such as, for example, the subsequent bulking, scouring, bleaching, shrinking, and the like, can be extremely uniformly carried out.

Obviously, many modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A feeding apparatus for a sheet-like material, which comprises:

a liquid supplying tank;

a downwardly extending curved slit type guide passage for the sheet-like material having a slit which is gradually decreased from an upper inlet portion thereof to a lower outlet portion;

means for supplying liquid from said liquid supply tank to both sides of said inlet portion of said guide passage for introducing said liquid stream into said slit type guide passage from along the entire width of both sides of said guide passage; and means for rectifying said stream of liquid from said supply means upstream of said inlet portion of said guide means in such a manner that substantially no flow pattern occurs in the direction of the width of said guide passage.

2. The feeding apparatus for a sheet-like material according to claim 1, wherein the width of the slit type guide passage is substantially constant.

3. The feeding apparatus for a sheet-like material according to claim 2, wherein said means for rectifying the stream of liquid comprises a plurality of parallel liquid rectifying plates arranged in contact with a wall of said liquid supplying tank and a bottom plate.

4. The feeding apparatus for a sheet-like material according to claim 3, wherein said means for supplying liquid to said guide passage comprises a plurality of liquid supplying holes provided in the wall of the liquid supplying tank at a position lower than the height of said liquid rectifying plates.

5. The feeding apparatus for a sheet-like material according to claim 1, further comprising means for introducing liquid into said liquid supplying tank.

6. The feeding apparatus for a sheet-like material according to claim 3, wherein said slit type guide passage comprises an upper plate, a lower plate and opposing side plates, all having smooth inner surfaces.

7. The feeding apparatus for a sheet-like material according to claim 6, wherein said upper plate of said slit type guide passage is fitted to the bottom plate of said rectifying means by a hinge.

8. The feeding apparatus for a sheet-like material according to claim 1, wherein the slit at its lower outlet portion of said slit type guide passage is 3 – 10mm and the ratio of the slit at its upper inlet portion to the slit at its lower outlet portion of said guide passage is 5 – 10.

9. The feeding apparatus for a sheet-like material according to claim 1, wherein the radius of curvature (R) of the guide passage is 100 – 600mm.

10. The feeding apparatus for a sheet-like material according to claim 1, wherein the angle ($\theta$) formed by the lower outlet portion of said guide passage and the horizontal level is 0° – 30°.

* * * * *